US006161827A

United States Patent [19]

Eugster et al.

[11] Patent Number: 6,161,827

[45] Date of Patent: Dec. 19, 2000

[54] METHOD OF COLLECTING PRINTED PRODUCTS TO FORM FINAL PRINTED PRODUCTS

[75] Inventors: Albert Eugster, Strengelbach; Felix Kramer, Vordemwald, both of Switzerland

[73] Assignee: Grapha-Holding AG, Hergiswil, Switzerland

[21] Appl. No.: 08/850,244

[22] Filed: May 2, 1997

[30] Foreign Application Priority Data

May 9, 1996 [CH] Switzerland ..... 1177/96

[51] Int. Cl.[7] ..... B65H 5/30

[52] U.S. Cl. ..... 270/52.14; 270/52.19; 271/204; 198/803.1

[58] Field of Search ..... 198/470.1, 803.4, 198/803.1, 867.07; 271/82, 85, 204, 205; 270/52.14, 52.16, 52.19, 52.25, 58.18

[56] References Cited

U.S. PATENT DOCUMENTS

| | | | |
|---|---|---|---|
| 4,743,005 | 5/1988 | Reist | 271/204 X |
| 5,052,666 | 10/1991 | Hansch | 270/55 |
| 5,188,349 | 2/1993 | Honegger | 271/204 X |
| 5,556,087 | 9/1996 | Gosslinghoff | 270/58.18 |
| 5,575,379 | 11/1996 | Schmetzer | 198/803.7 X |
| 5,713,565 | 2/1998 | Meier | 270/52.16 |
| 5,746,425 | 5/1998 | Flannery, Jr. | 270/52.14 |

*Primary Examiner*—Christopher P. Ellis
*Assistant Examiner*—Patrick Mackey
*Attorney, Agent, or Firm*—Friedrich Kueffner

[57] ABSTRACT

A method and an apparatus for collecting or gathering printed products to form final printed products, such as newspapers, magazines, brochures and/or books, wherein the printed products are moved along supply lines and are supplied to one or more processing locations. At least two of the printed products intended for forming a final printed product are combined at a collecting point provided in a supply line and the combined printed products are further transported together.

18 Claims, 3 Drawing Sheets

METHOD OF COLLECTING PRINTED PRODUCTS TO FORM FINAL PRINTED PRODUCTS

BACKGROUND OF THE INVENTION

1. Field of the Invention

The present invention relates to a method of collecting or gathering printed products to form final printed products, such as newspapers, magazines, brochures and/or books, wherein the printed products are moved along supply lines and are supplied to one or more processing locations.

The present invention also relates to an apparatus for carrying out the method.

2. Description of the Related Art

When manufacturing final printed products, such as newspapers, by inserting a subsequent printed product into the open principal product or initial product, an insertion machine available for this purpose is frequently not sufficient for collecting the complete printed product in one operation because the feeding stations of a permanently installed plant are not available.

This situation makes it necessary to carry out another operation after the previously processed printed products have been temporarily stored, so that the printed products can be fed to further processing.

This problem can be essentially eliminated by installing the insertion machine from the outset with more than the planned feeding stations for printed products. However, the resulting higher procurement costs and operating costs as well as the larger space required mean that the processing operations are not economical when the plant does not operate with sufficient capacity.

SUMMARY OF THE INVENTION

Therefore, it is the primary object of the present invention to further develop the method of the above-described type in such a way that the existing capacity of a permanently installed plant can be increased.

In accordance with the present invention, at least two of the printed products intended for forming a final printed product are combined at a collecting point provided in a supply line and the combined printed products are further transported together.

The method according to the present invention makes it possible to significantly improve the production and almost double the capacity of a plant without expensive alterations of the existing insertion machine.

Moreover, this method of operation permits further processing of the printed products from a stream feeder or individually, for example, through a star feeder.

When collecting two printed products to form a partial product of the final printed product, a simple manner of operation is to remove from an opened clamping device one of the printed products transported on the supply line in the clamping device, to transport the printed product together with the open clamping device, and, after feeding another printed product into the open clamping device, grasping both printed products by means of the clamping device.

The printed products advantageously can be grasped placed next to each other and, thus, form a compact partial product which can be used in a favorable manner during further processing.

The two printed products can be combined by providing the collecting point with an intermediate conveyor which accompanies the supply line and temporarily grasps the printed products supplied on the supply line. The intermediate conveyor interacts alternatingly with the clamping device and grasps the printed product supplied on the supply line from the clamping device and then releases the printed product again so that it can be grasped by the clamping device.

The apparatus according to the present invention for carrying out the above-described method includes an endless conveyor or an intermittent conveyor which supplies printed products held in clamps on a supply line to a processing point. Underneath the conveyor is arranged a circulating conveyor which extends into the travel path of the printed products and feeds another printed product to an open clamping device of the endless or intermittent conveyor, wherein the circulating conveyor and the endless or intermittent conveyor are operated in the same cycle, i.e., synchronously, and are operated essentially in the same direction in the area of the collecting point. Together with an intermediate conveyor which is located opposite the travel path of the printed products and is formed by gripping members actuated by control means and is driven approximately in the same direction with the endless or intermittent conveyor in the area where the conveyors converge, the circulating conveyor forms the collecting point of two printed products to be collected or combined.

For supporting the additional printed products, the circulating conveyor is formed by controllable support members which are fastened spaced apart to a pull means and which communicate with the open clamping devices at the collecting point.

In order to be able to process printed products having different sizes in the above-proposed manner, wherein the printed products collected on the clamping device may be different as well as those at the endless or intermittent conveyor and the circulating conveyor, the distance of the circulating conveyor from or its position relative to the endless or intermittent conveyor and the clamping devices on the supply line may be adjustable vertically as well as longitudinally in conveying direction, so that the interacting members can be adapted to the respectively selected conditions.

In order to advantageously influence the feeding of the printed products to the collecting point, a guide device extending along the endless or intermittent conveyor is arranged in front of the collecting point, wherein the guide device changes the suspended position of each printed product conveyed on the endless or intermittent conveyor, so that the feeding area to the clamping devices is expanded.

In accordance with an advantageous feature, the support members of the circulating conveyor are constructed so as to be fed by a transporter or conventional feeder, wherein, in the case of a transporter, the transporter and the circulating conveyor form a common feeding and transfer stretch.

It has been found suitable if, after being grasped by the circulating conveyor, the additional printed products protrude with the end facing the clamping device beyond the support member, so that the additional printed products can project without problems into the clamping devices for the transfer to the clamping devices.

The intermediate conveyor may be constructed as a rotor driven about a horizontal axis extending perpendicularly to the conveying direction of the endless or intermittent conveyor, wherein the rotor includes tongs fastened to the circumference of the rotor and capable of being actuated by control means. The tongs can be driven or actuated so as to synchronously interact with the clamping devices of the endless or intermittent conveyor.

Alternatively, instead of providing an intermediate conveyor, each clamping device may include a third controllable clamping member which, together with a clamping member of a first clamp of the clamping device, forms a second clamp; the same high operational reliability can be achieved with this second clamp.

In accordance with a simple feature, the clamping device has one stationery and two controllable, moveable clamping members.

The moveable clamping members may be arranged so as to act on both sides of the rigid clamping member, or the moveable clamping members may be arranged on one side of the rigid clamping member so as to interact with the rigid clamping member and with each other.

The apparatus according to the invention is suitable for use with a feeding machine, wherein the apparatus is arranged upstream of the feeding machine in a supply line.

The circulating conveyor of the apparatus may optionally be constructed so as to be moveable relative to the endless or intermittent conveyor.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
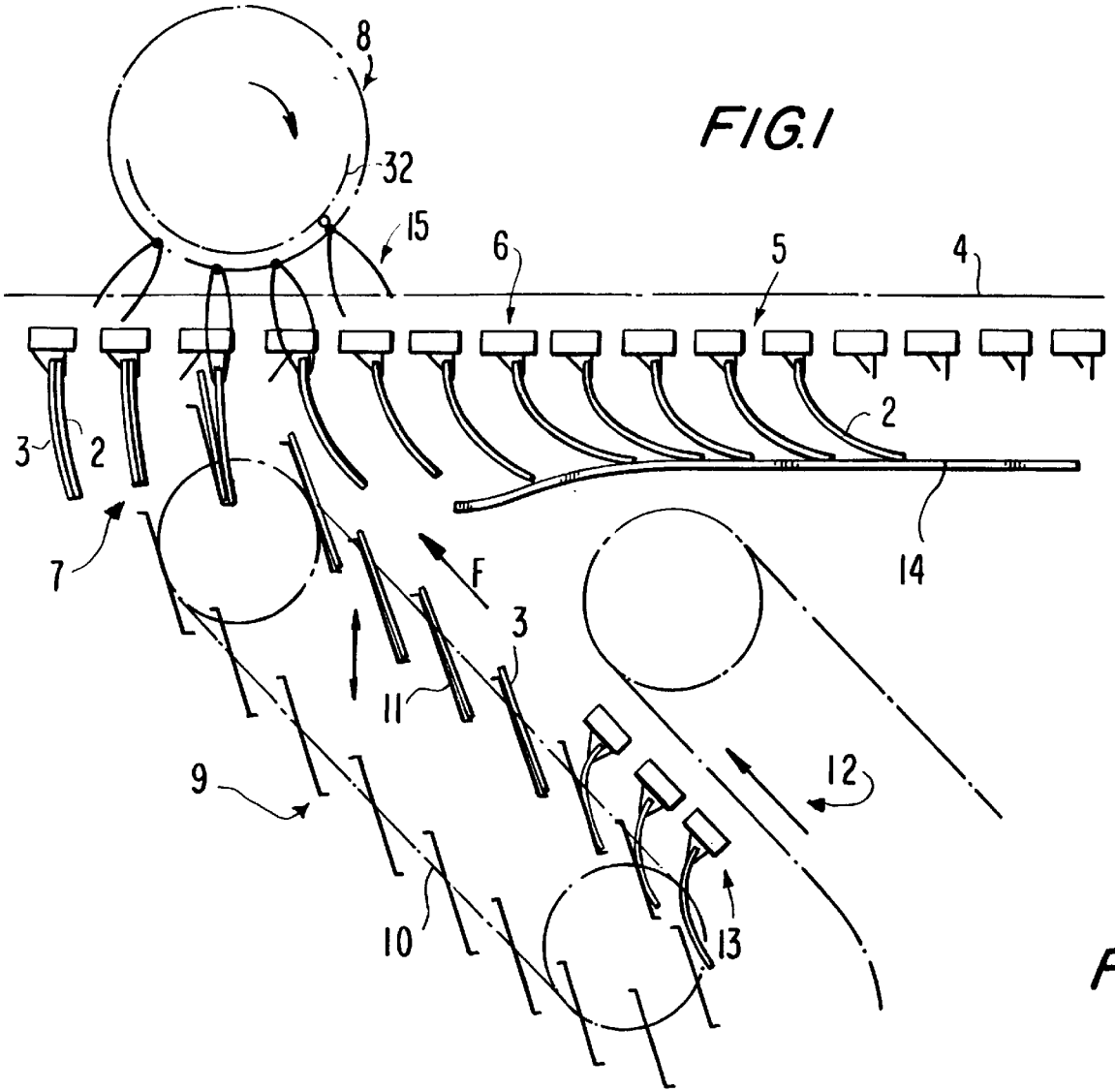
FIG. 1 is a schematic side view of the apparatus according to the present invention.

FIG. 1 of the drawing shows an apparatus for collecting printed products 2,3 of different types to form final printed products or partial products. The printed products 2 are supplied, for example, along supply lines 4, from a printing machine or from storage units by means of a conveyor 5 to one or more processing points or stations, not shown, wherein the conveyor 5 is constructed as an endless pull member with successively spaced-apart clamping devices 6 arranged on the pull member.

The conveying portion of the conveyor 5 has a collecting point 7 arranged in front or upstream of a processing point, not shown, wherein another or additional printed product 3 can be fed to each clamping device 6 of the conveyor 5. Both printed products 2, 3 are brought together at the collecting point 7 and are conveyed further together in the clamping device 6 of the conveyor 5 to the next processing point.

Before the printed product 3 is transferred to the clamping device 6, the printed product 2 is grasped at the collecting point 7 by an intermediate conveyor 8 and is immediately subsequently freed from the clamping device 6 which opens for this purpose. At the intermediate conveyor 8, the printed product 2 travels alongside the open clamping device 6 and a conveyor 9 feeds another printed product 3 to the clamping device.

The conveyor 9 is composed of circulating support members 11 fastened to an endless pull means 10, wherein the support members 11 can be controlled so as to be moved into a conveying position and the support members 11 can be supplied with printed products. Together with a conveying unit 12 shown partially in the drawing, the conveyor 9 forms a transfer area 13 in which the printed products 3 are fed to the support members 11 of the conveyor 9. At the time the printed product 3 is transferred, this requires an at least approximately synchronous interaction of conveyor 9 and conveying unit 12.

For this purpose, in the illustrated embodiment, the conveying portions of conveyor 9 and conveying unit 12 determining the transfer area are arranged so as to extend approximately parallel to each other, so that movements in the same direction and with the same speed are possible to enable the support members 11 to receive the printed products 3.

As indicated by a double arrow in FIG. 1, the position of the conveyor 9 is adjustable relative to the conveyor 5.

As illustrated in the drawing, the printed products 3 protrude beyond the support members 11 of the conveyor 9 toward the clamping device 6, so that the clamping device 6 can grasp the printed products 3 without interference.

Before reaching the clamping devices 6, the printed products 3 assume an inclined position in conveying direction F in order to be able to travel underneath the respective printed product 2 prior to being combined with the printed product 2.

For this purpose, the printed product 2 slides with its freely moveable end over a guide device 14 for providing a larger feeding area for the printed product 3 before the latter is moved with its forward end into the open clamping device 6.

The clamping device 6 grasps both printed products 2 and 3 and the intermediate conveyor 8 is separated from the printed product 2. Of course, the clamping devices 6 of the conveyor 5 or the tongs 15 could also be controlled in such a way that they travel together for a short distance in order to favorably affect the transfer conditions.

Figure 3:
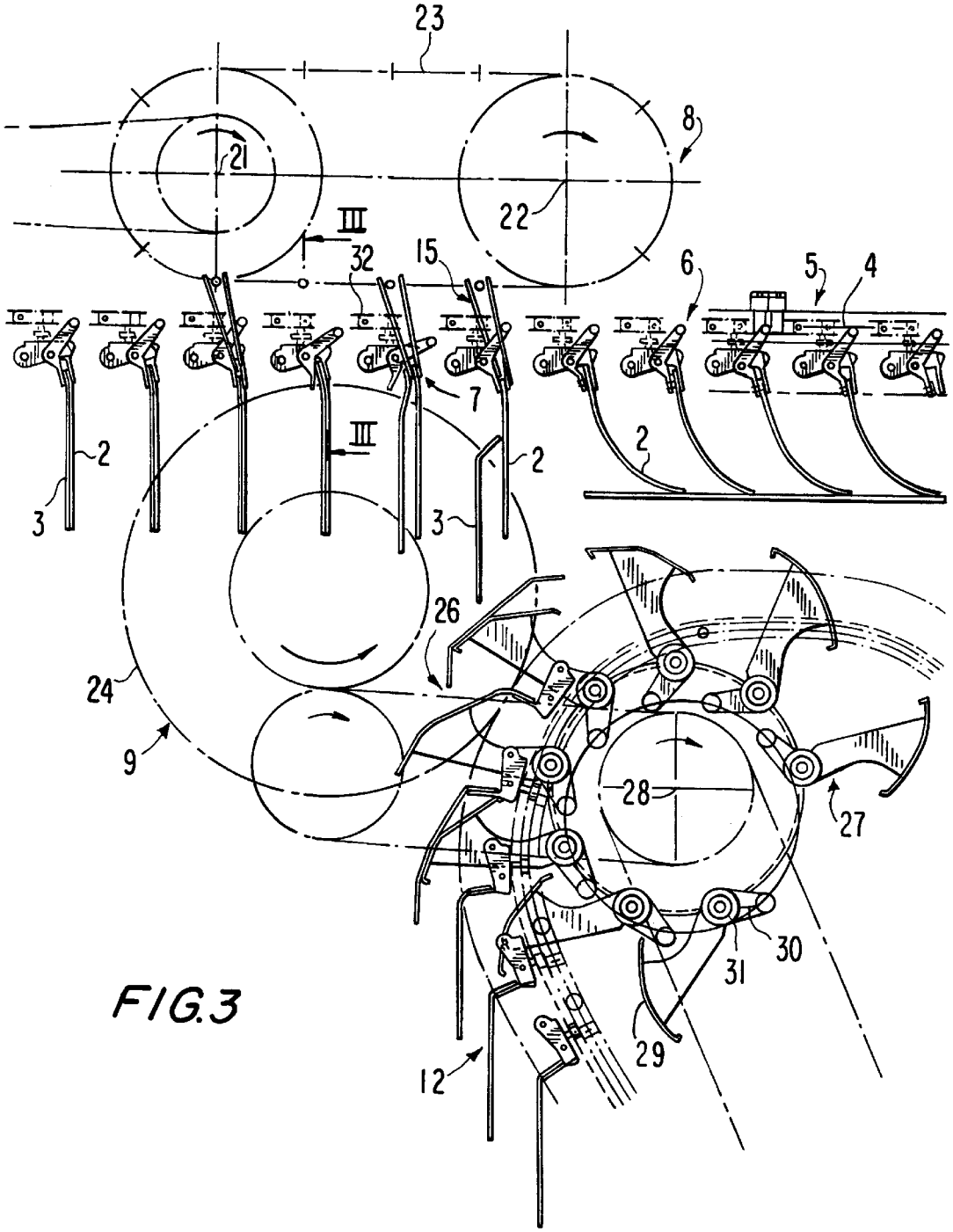
FIG. 3 is a side view of another embodiment of the apparatus according to the present invention which differs from the embodiment shown in FIG. 1 with respect to the intermediate conveyor and the feeding device.
Figure 4:
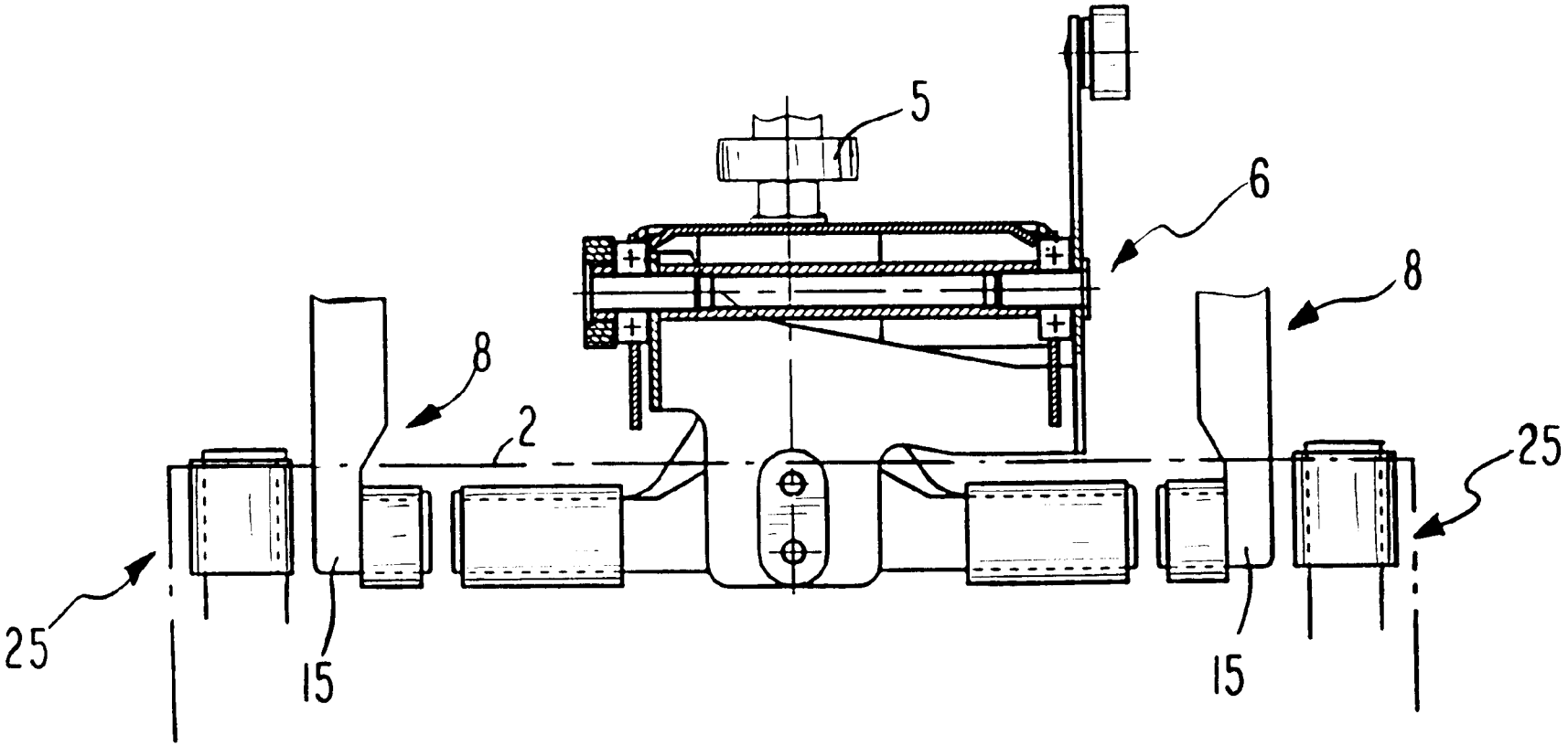
FIG. 4 is a sectional view of the intermediate conveyor taken along sectional line III—III of FIG. 3

FIGS. 1 and 3 schematically show control arms 32 for controlling the tongs 15.

Figure 2:
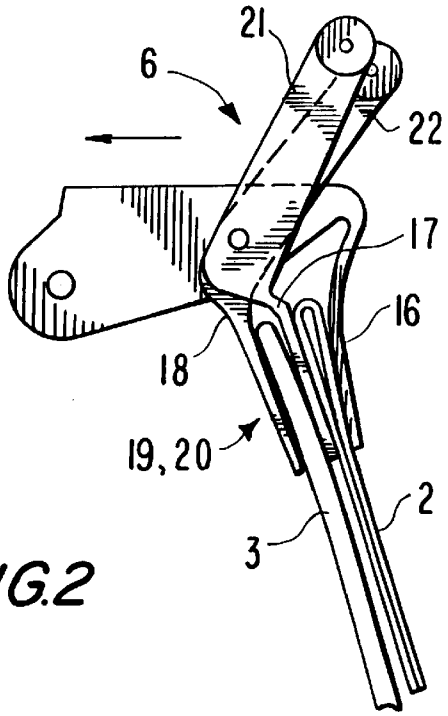
FIG. 2 is a side view, on a larger scale, showing an alternative embodiment of the clamping device of the apparatus.

Instead of providing the intermediate conveyor 8, the clamping devices 6 feeding the printed products 2 on the conveyor 5 could also be constructed of several components, i.e., three clamping members. This means that each clamping device 6 composed of a first rigid clamping member 16 and a first moveable clamping member 17 has an additional second moveable clamping member 18 which, as illustrated in FIG. 2, acts on the rearward of the first moveable clamping member 17 or forms a second clamp together with the rear side of the rigid clamping member 16.

This means that the first rear clamp 19 which conveys the printed product 2 does not open while the printed product 3 is transferred to the open second clamp 20 of the clamping device 6.

The second clamp 20 is closed as soon as the printed product 3 has reached its clamped position. The two printed products 2 and 3 are now conveyed together by means of the conveyor 5 to the processing location. The clamps 19, 20 or the moveable clamping members 17, 18 are actuated by means of control cams which act on the control leavers 21, 22 of the respective clamping members 17, 18.

If more than two printed products 3 are to be received on the supply line 4, it appears more advantageous to provide several intermediate conveyors 8 instead of using clamping devices 6 having multiple components.

FIG. 3 of the drawing shows an intermediate conveyor 8 which includes tongs 15 fastened spaced-apart to pull members 23 travelling around two axles 21, 22, wherein the tongs 15 temporarily carry the printed products 2 supplied by the clamping device 6 until the printed product 3 is inserted into the clamping device 6. As compared to the embodiment of FIG. 1, the embodiment of FIG. 3 differs in that a longer transfer stretch is provided which extends parallel to the supply line.

The conveyor 9 is formed by a drum 24 which has gripping members 25 distributed on the circumference thereof. The gripping members 25 grasp the printed products 3 at the side edges thereof after they have been supplied by a conveying device or transporter 12. Near the circumferential travel path of the conveying device 12, the gripping member 12 forms a transfer point at which the gripping members 25 travel approximately in the same direction as the conveying device 12.

The conveying device 12 has at the transfer point 26 a convexly curved conveyor portion directed toward the drum 24, wherein a lifting device 27 travels along the conveyor portion underneath the printed products 3 conveyed by the conveying device 12 and clamped at the fold thereof in order to lift the printed products 3 out of the freely suspended position and to enable the gripping members 25 to laterally grasp the printed products 3.

For this purpose, the lifting device 27 includes a plurality of pivotally controlled support elements 29 which travel around an axis 28 extending parallel to the drum 24 and temporarily grasp the printed products 3, wherein the travel path of the support elements 29 intersects the travel path of the gripping members 25 of the drum 24.

The travel path of the support elements 29 is circular and each support element 29 has a lever 30 resting against a pivot axis 31 and connected to the support elements 29, wherein the levers 30 are adjustable by a control cam.

The invention is not limited by the embodiments described above which are presented as examples only but can be modified in various ways within the scope of protection defined by the appended patent claims.

We claim:

1. A method of collecting printed products to form final printed products, such as newspapers, magazines, brochures and/or books, wherein the printed products are supplied to one or more processing locations along at least one supply line, the method comprising feeding at least two of the printed products for a final printed product so as to be combined at a collecting point located in a supply line, and further transporting the combined printed products in the supply line, wherein the printed products are transported along the supply line in a clamping device, further comprising temporarily releasing each printed product at the collecting point from the open clamping device, transporting the printed products together with the open clamping device and, after feeding another printed product into the open clamping device, grasping both printed products by means of the clamping device, and wherein the printed products are combined placed next to each other when being grasped by the clamping device, further comprising temporarily grasping the printed products supplied along the supply line at the collecting point by means of an intermediate conveyor which accompanies the supply line and alternatingly interacts with the clamping device.

2. An apparatus for collecting printed products to form final printed products, such as newspapers, magazines, brochures and books, the apparatus comprising an endless conveyor having clamping devices for feeding printed products to one or more processing locations along a supply line, the endless conveyor being configured to open the clamping devices at a collecting point, a circulating conveyor arranged underneath the endless conveyor and extending into a travel path of the clamping devices for feeding additional printed products to open clamping devices of the endless conveyor, the circulating conveyor and the endless conveyor being configured to operate synchronously and essentially in the same direction at the collecting point, further comprising an intermediate conveyor located opposite the travel path of the clamping devices, the intermediate conveyor comprising gripping members actuated by control means and driven approximately in the same direction as the endless conveyor at the collecting point, whereby each printed product fed by the endless conveyor is combined with another printed product fed by the circulating conveyor.

3. The apparatus according to claim 2, wherein the circulating conveyor comprises controllable support members attached spaced-apart from each other to a pull member, wherein the support members communicate with the open clamping device at the collecting point.

4. The apparatus according to claim 2, further comprising a guide device at the collecting point for placing the printed products fed by the endless conveyor into a dragged position.

5. The apparatus according to claim 3, further comprising a conveying unit for feeding printed products to the support members of the circulating conveyor.

6. The apparatus according to claim 5, wherein the support members of the circulating conveyor are configured such that the printed products protrude beyond the support members with an end facing the clamping device.

7. The apparatus according to claim 6, wherein the support members of the circulating conveyor are configured to place the printed products into an inclined position.

8. The apparatus according to claim 2, wherein the intermediate conveyor comprises a rotor driven about a horizontal axis extending perpendicular to the feeding direction of the endless conveyor.

9. The apparatus according to claim 8, wherein the rotor comprises controllable tongs attached to a circumference of the rotor.

10. The apparatus according to claim 2, wherein each clamping device comprises first and second clamping members forming a first clamp and a third controllable clamping member forming a second clamp with one of the clamping members of the first clamp.

11. The apparatus according to claim 10, wherein the clamping device comprises a stationary clamping member and two controllable and moveable clamping members.

12. The apparatus according to claim 11, wherein the moveable clamping members are arranged on both sides of the stationary clamping member.

13. The apparatus according to claim 11, wherein both moveable clamping members are arranged on one side of the stationary clamping member so as to interact with each other.

14. The apparatus according to claim 2, wherein the intermediate conveyor comprises controllable tongs attached to at least one pull member travelling around to axles.

15. The apparatus according to claim 2, wherein each support member of the circulating conveyor comprises a controllable additional gripping member attached to a drum.

16. The apparatus according to claim 5, wherein near a circumferential travel path of the conveying unit is formed a transfer point with gripping additional members travelling approximately in the same direction as the conveying device.

17. The apparatus according to claim 15, wherein the travel path of the conveying unit has a convexly curved conveyor portion directed toward the circulating conveyor, wherein each printed product has a fold, further comprising a lifting device travelling along the conveyor portion underneath the printed products conveyed by the conveying unit and clamped at the fold thereof for lifting the printed products out of a freely suspended position and for grasping the printed products by means of the gripping members at side edges thereof.

18. The apparatus according to claim 17, wherein the lifting device comprises pivotable support elements arranged so as to travel around an axis extending parallel to the drum, wherein the travel path of the support elements intersects the travel path of the gripping members of the drum.

* * * * *